US005203583A

United States Patent [19]

LeGrand et al.

[11] Patent Number: 5,203,583

[45] Date of Patent: Apr. 20, 1993

[54] SKI FURNISHED WITH FRONT MASSES OF INERTIA

[75] Inventors: Maurice LeGrand; Francois Guers, both of Annecy, France

[73] Assignee: Salomon S.A., Annecy Cedex, France

[21] Appl. No.: 829,562

[22] Filed: Feb. 5, 1992

Related U.S. Application Data

[63] Continuation of Ser. No. 431,868, Nov. 6, 1989, abandoned.

[30] Foreign Application Priority Data

Nov. 7, 1988 [FR] France ..... 88 15724

[51] Int. Cl.[5] ..... A63C 5/075

[52] U.S. Cl. ..... 280/602; 280/610; 280/809

[58] Field of Search ..... 280/601, 602, 608, 609, 280/610, 809

[56] References Cited

U.S. PATENT DOCUMENTS

| | | | |
|---|---|---|---|
| 3,537,717 | 11/1970 | Caldwell | 280/602 |
| 3,747,947 | 7/1973 | Gunzel | 280/602 |
| 4,199,169 | 4/1980 | Guenzel et al. | 280/602 |
| 4,405,149 | 9/1983 | Piegay | 280/602 |
| 4,563,020 | 1/1986 | Arieh et al. | 280/602 |
| 4,639,009 | 1/1987 | Meatto et al. | 280/602 |
| 4,848,784 | 7/1989 | Scherübl | 280/602 |
| 4,865,345 | 9/1982 | Piegay | 280/602 |

FOREIGN PATENT DOCUMENTS

| | | | |
|---|---|---|---|
| 337581 | 7/1977 | Australia . | |
| 0102653 | 3/1984 | European Pat. Off. . | |
| 1960684 | 6/1970 | Fed. Rep. of Germany . | |
| 2052332 | 9/1976 | Fed. Rep. of Germany . | |
| 2842196 | 4/1980 | Fed. Rep. of Germany . | |
| 3803507 | 9/1988 | Fed. Rep. of Germany | 280/602 |
| 2382245 | 9/1978 | France . | |
| 2615406 | 11/1988 | France . | |
| 98831 | 8/1979 | Japan | 280/602 |

OTHER PUBLICATIONS

A Copy of the French Search Report of French Appln. No. 88 15724.

*Primary Examiner*—David M. Mitchell
*Attorney, Agent, or Firm*—Sandler Greenblum & Bernstein

[57] ABSTRACT

A ski in which one or more additional masses of inertia are added to change the characteristics of the ski. A front additional mass of inertia is located substantially at a front transverse line of contact of the bottom surface of the ski with the ground. A rear additional mass of inertia may be located substantially at a rear transverse line of contact with the ground.

16 Claims, 7 Drawing Sheets

SKI FURNISHED WITH FRONT MASSES OF INERTIA

This application is a continuation of application Ser. No. 07/431,868, filed Nov. 6, 1989, now abandoned.

BACKGROUND OF THE INVENTION

1. Field of the Invention

The present invention relates to skis in which one or several additional masses of inertia are added to modify and adjust the moment of inertia of the ski, both about a vertical axis and about a horizontal axis, which is perpendicular to the longitudinal direction of the ski.

2. Description of Background and Relevant Information

The moment of inertia about the vertical axis or rotation axis of the ski influences the performance of the ski in rotation, by determining the resistance of the ski to a variation in the direction of movement. A ski with a low moment of inertia, for example a short ski or a ski that is light at its ends, is easier to turn than a ski with a high moment of inertia. A ski that is easy to turn is particularly suitable for special snow conditions, such as deep snow, springtime snow, and for special terrain conditions, such as slopes with moguls. A ski with a high moment of inertia, for example an elongated ski or a ski having relatively significant masses at its ends, is particularly consistent when turning during a rapid descent, because the forces exerted laterally on the ski by the unevenness of the slope are better absorbed because of the higher moment of inertia.

The moment of inertia of the ski about its central horizontal axis which is perpendicular to the longitudinal direction of the ski influences the vibratory behavior of the ski. It is known that vibrations can be detrimental and can lead to the edges of the ski losing adherence with the ground, and, as a result, instability when turning.

Moreover, modern ski construction techniques are directed to lighter and lighter ski structures, which comprise, for example, a central core of light cellular material, surrounded by a structure of mechanical resistance in a casing. The lightness of such a structure leads to a substantial decrease in the moment of inertia and introduces the above-mentioned defects. It is known that such defects can be corrected by attaching additional masses of inertia to the ski.

In German Patent No. 2,052,332, the moment of inertia of a ski is modified by displacing masses in the direction of its length and fixing the masses on or within the rear or front portion of the ski. By modifying the distance of the masses from the two ends of a ski, the moment of inertia of the ski can be varied, both about the vertical axis and about the central horizontal axis which is perpendicular to its longitudinal direction. The practice of this system is however very difficult and expensive. The positioning of masses on the outside of the ski cannot practically be used because snow can accumulate in the adjustment elements and prevent their functioning. The positioning of masses within the ski unfortunately weakens the section of the ski, and requires the construction of entirely new skis having a hollow section for the masses and the displacement elements. Moreover, it appears that it is not possible to position such an .adjustable structure -for additional masses of inertia in the areas to obtain a satisfactory result, because these areas have too little thickness to receive the displacement elements for the masses of inertia. Satisfactory placement in these areas is the object of the present invention, and will be described in detail below.

French Patent No. 2,382,245 discloses positioning additional masses of inertia on the upper surface at the two ends of the ski. This document does not disclose the positioning of masses of inertia in particular areas to obtain the appropriate effect, as will be described below.

SUMMARY OF THE INVENTION

The present invention is related to a ski having an upper and lower surface and a front end which is turned upwardly. The lower surface includes a contact surface for contacting the ground which is connected to the front end at a front transverse line of contact, and a front additional mass of inertia which is positioned substantially at the front transverse line of contact. The front additional mass of inertia is distributed on both sides of a vertical plane passing through the front line of contact and may be substantially centered about the vertical plane. The front additional mass of inertia may have a length substantially between 15 and 25 centimeters and the distance between the front end of the front additional mass of inertia and the vertical plane may be substantially between 1 and 10 centimeters and the distance between the rear end of the front additional mass of inertia and the vertical plane may be substantially between 0 and 15 centimeters.

According to another aspect of the invention, the ski is curved and shaped such that the contact pressure between the contact surface and the ground is relatively high at the location of the front additional mass of inertia. The front additional mass of inertia weighs between 40 and 200 grams. The ski further includes a rear transverse line of contact, and a rear additional mass of inertia is positioned substantially at the rear transverse line of contact. The difference between the weight of the front additional mass of inertia and the weight of the rear additional mass of inertia is approximately 50 grams.

The front additional mass of inertia may be attached to the upper surface of the ski. However, preferably the ski includes an internal structure with the front additional mass of inertia being incorporated into the internal structure. The ski includes laterally spaced edges, the front additional mass of inertia including at least two half-masses of inertia being respectively positioned substantially at the edges.

According to another aspect of the invention, the ski includes a longitudinal axis and further includes an auxiliary mass of inertia positioned along the longitudinal axis.

According to an embodiment of the invention, the ski includes a core and two half-masses are respectively positioned on both sides of the core. The edges may include inclined sides with the half-masses being shaped to follow the inclination of the inclined sides.

The invention is directed to an improvement in a ski having an upper and lower surface, side edges, an internal core, and a front end which is turned upwardly, the lower surface including a contact surface for contacting the ground which is connected to the front end at a front transverse line of contact, wherein the improvement comprises a front additional mass of inertia positioned substantially at the front transverse line of contact. The front additional mass of inertia is distributed on both sides of a vertical plane passing through the first transverse line of contact and may be substantially centered about the vertical plane.

The front additional mass of inertia may include at least two half-masses of inertia respectively positioned substantially at the side edges and on both sides of the core. The side edges may include inclined sides with the half-masses being shaped to follow the inclination of the inclined sides.

The ski also includes a rear transverse line of contact, and further includes a rear additional mass of inertia located substantially at the rear transverse line of contact.

BRIEF DESCRIPTION OF THE DRAWINGS

The invention is further explained in the description which follows with reference to the drawings illustrating, by way of non-limiting examples, various embodiments of the invention wherein.

DETAILED DESCRIPTION OF THE PREFERRED EMBODIMENT

Figure 1:
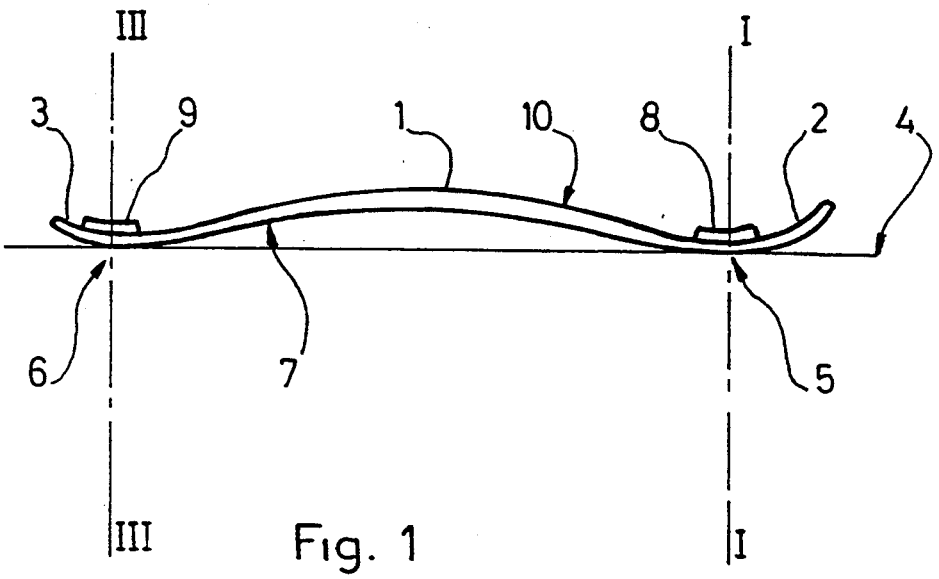
FIG. 1 is a schematic side view of a ski according to the present invention, which is shown unloaded on a plane.

An object of the present invention is to achieve a ski with a light structure having appropriate pivoting inertia, and having vibratory behavior in flexion to have the appropriate properties desired. Such a ski substantially improves the precision and regularity in turning by the slightest sensitivity at the front of the ski in relation to the contours of the slope. The turning stability is substantially improved so as to be similar to that of heavy skis, however, without increasing the total weight of the ski and by keeping the weight substantially lower than that of heavy skis. As a result, the ski can be oriented easily with low displacement or rotation velocity, while its relatively high moment of inertia absorbs the rapid forces and vibrations transmitted by the contours of the slope. This results in less physical and psychological fatigue to the skier.

To attain these objects as well as others, the ski, according to the invention, includes a light structure, with a cellular core, and is furnished, at least in its front portion, with an element of greater density than the average density structure of the ski body and which constitutes a front additional mass of inertia. The ski body comprises a front end which turns up in a spatula, and a rear end which is also slightly turned up. The lower contact surface of the ski, as in conventional skis, ends towards the front and is connected to the lower surface of the spatula along a front transverse line of contact. A rear transverse line of contact defines the rear end of the contact area of the ski body. According to the invention, the front mass of inertia is fixed and located near the front transverse line of contact. The front mass of inertia is thus moved the maximum amount from the center of the ski, thus obtaining a maximum moment of inertia for a given mass. The location of the additional mass of inertia near the transverse line additionally avoids the occurrence of secondary vibratory effects, which occur when an additional mass of inertia is placed near the ends of the ski, i.e., at the turned up front portion of the ski which forms the spatula, or at the rear portion of the ski which is also turned up.

Preferably, the front mass of inertia is substantially centered on a vertical plane passing through the front transverse line of contact, and is distributed longitudinally over a predetermined length on both sides of the vertical plane. It is preferable that the mass of inertia be distributed over a predetermined length, because this especially avoids having the sensation of "hitting" a mogul or leaping while skiing.

Good results can be obtained by positioning the additional front mass of inertia in an area extending from 15 centimeters to the rear of the vertical plane passing through the front line of contact, and 10 centimeters in front of the vertical plane.

The ski body is preferably curved. Such a structure, combined with the particular position of the front mass of inertia, places this mass of inertia in the area in which the contact pressure between the lower surface of the ski and the ground is at a relative maximum According to the invention, it is preferable to associate with the additional mass of inertia placed in front of the ski, an additional mass of inertia placed at the rear of the ski, which is of a value lower than the front additional mass of inertia. The rear mass is positioned near the rear end of the contact area of the ski (rear line of contact).

According to one embodiment, the additional masses are centered near the vertical longitudinal median plane of the ski and can be relatively close to this plane.

According to another preferred embodiment, to increase the moment of inertia of the ski about its longitudinal axis, the front mass of inertia is distributed in two lateral half-masses which are positioned, respectively, on both sides of the vertical longitudinal median plane of the ski and near the lateral edges of the ski.

Figure 2:
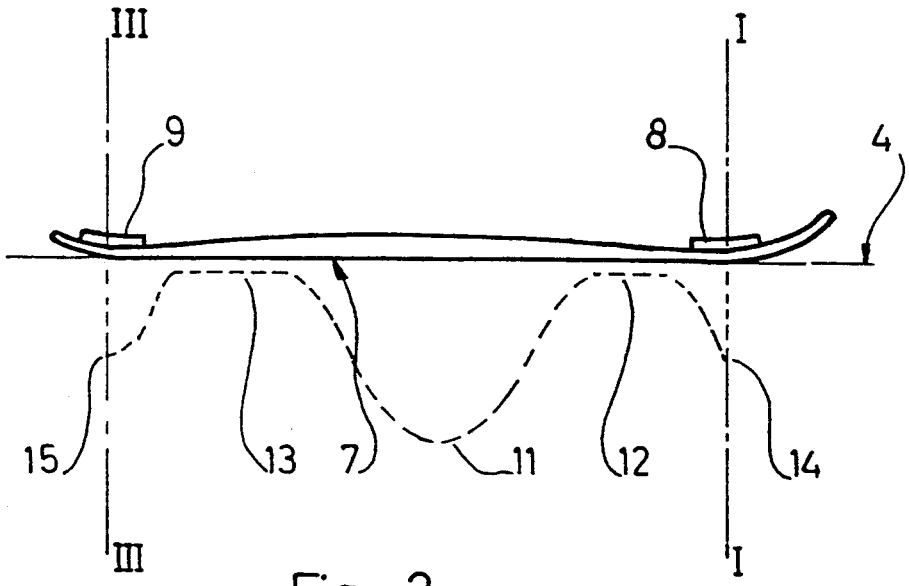
FIG. 2 illustrates the distribution of contact pressure under the lower surface of the ski when a load is applied.

As shown in FIGS. 1 and 2, the ski, according to the present invention comprises, in a conventional manner, a ski body 1 whose central part is curved in an upward arc and whose two ends are turned upwardly. The front end forms a spatula 2 and the rear end 3 also turns upwardly.

When the unloaded ski rests on a plane 4, the curving of the central part of body 1 makes the ski rest on plane 4 along two transverse lines, that is, a front transverse line of contact 5 and a rear transverse line of contact 6. During usage, the loaded ski is adapted to rest on the ground along its lower contact surface 7 which is limited by the two lines of contact 5 and 6.

A front additional mass of inertia 8 is placed near the front transverse line of contact 5 and a rear additional mass of inertia 9 is placed near the rear transverse line of contact 6.

According to one embodiment, additional masses of inertia 8 and 9 are affixed to upper surface 10 of the ski.

According to another embodiment, additional masses of inertia 8 and 9 are affixed and incorporated into the ski body, which may not be visible or only partially visible on upper surface 10 of the ski.

In FIG. 2, a ski is shown furnished with its two additional masses of inertia 8 and 9 being placed on planar surface 4, and subjected to a load such as the weight of a skier. Under the effect of the load, lower contact surface 7 of the ski is entirely in contact with surface 4. However, because of the upwardly curving effect of the ski body, the contact pressure between lower ski surface 7 and surface 4 varies with respect to the particular longitudinal position along the ski. This pressure has a maximum value 11 under t he central area occupied by the bindings which receives the weight of the skier. This pressure then has a minimum value on both sides of maximum value 11, particularly at minimum location 12 in the front third of the ski and minimum location 13 in the rear third of the ski. The pressure has another relative maximum value 14 near front transverse line of contact 5 of the ski and a second relative maximum value 15 near rear transverse line of contact 6 of the ski. Thus, when additional masses of inertia 8 and 9 are positioned near the front and rear lines of contact of the ski, their positions correspond to points of relative maximum contact pressure under the ski surface.

Figure 3:
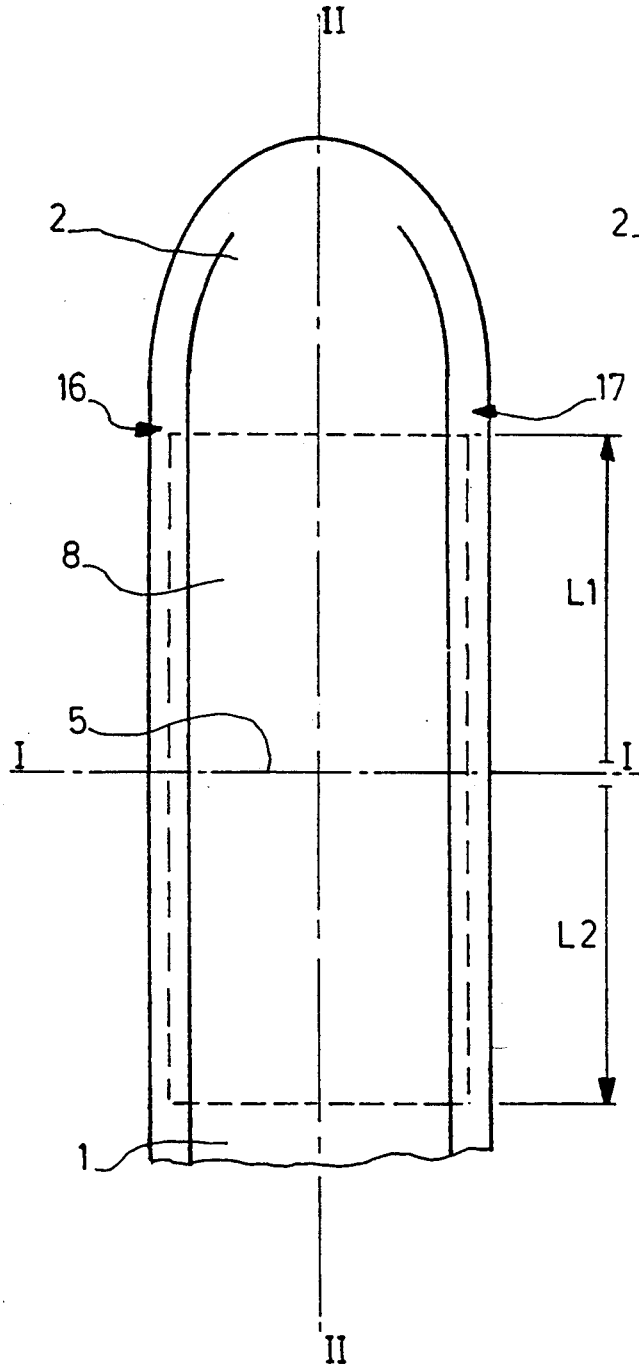
FIG. 3 shows, in top view, the position of the front additional mass of inertia according to a first embodiment of the invention.
Figure 4:
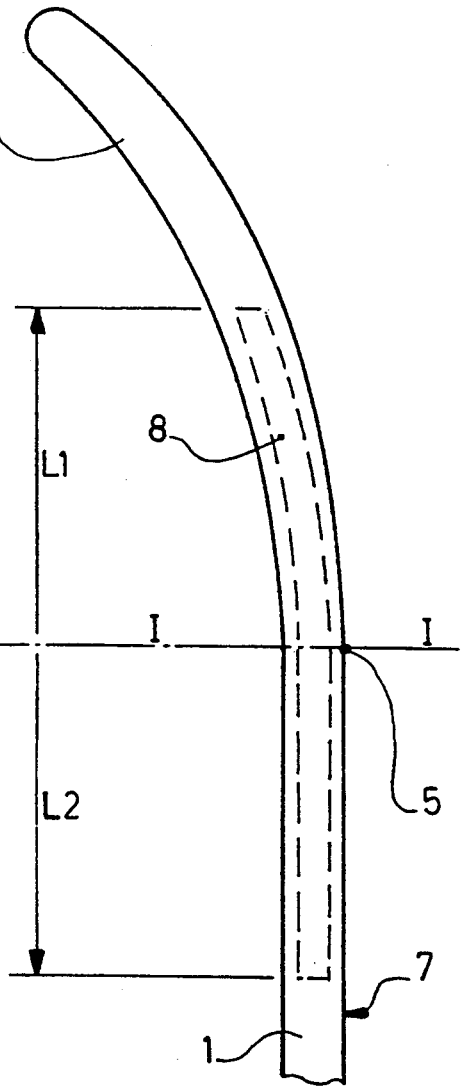
FIG. 4 is a side view of the ski of FIG. 3.

FIGS. 3 and 4 show a first embodiment of a front additional mass of inertia on the ski. According to this first embodiment, front additional mass of inertia 8 is in one piece, and is uniformly distributed on both sides of the longitudinal median axis II—II of the ski. For example, it can be a plate of constant thickness, having a density greater than the average density of ski body 1. The additional mass of inertia 8 extends as far as edges 16 and 17 of the ski.

Preferably, additional front mass of inertia 8 is distributed on both sides of the vertical plane I—I, which passes through front transverse line of contact 5 and has a predetermined length of approximately 15–25 centimeters. The distance L1 between the front end of additional mass of inertia 8 and the vertical plane I—I which passes through front transverse line of contact 5 is preferably between 0 and 10 centimeters, and the distance L2 between the rear end of additional mass of inertia 8 and the vertical plane I—I is preferably between 0 and 15 centimeters.

Figure 5:
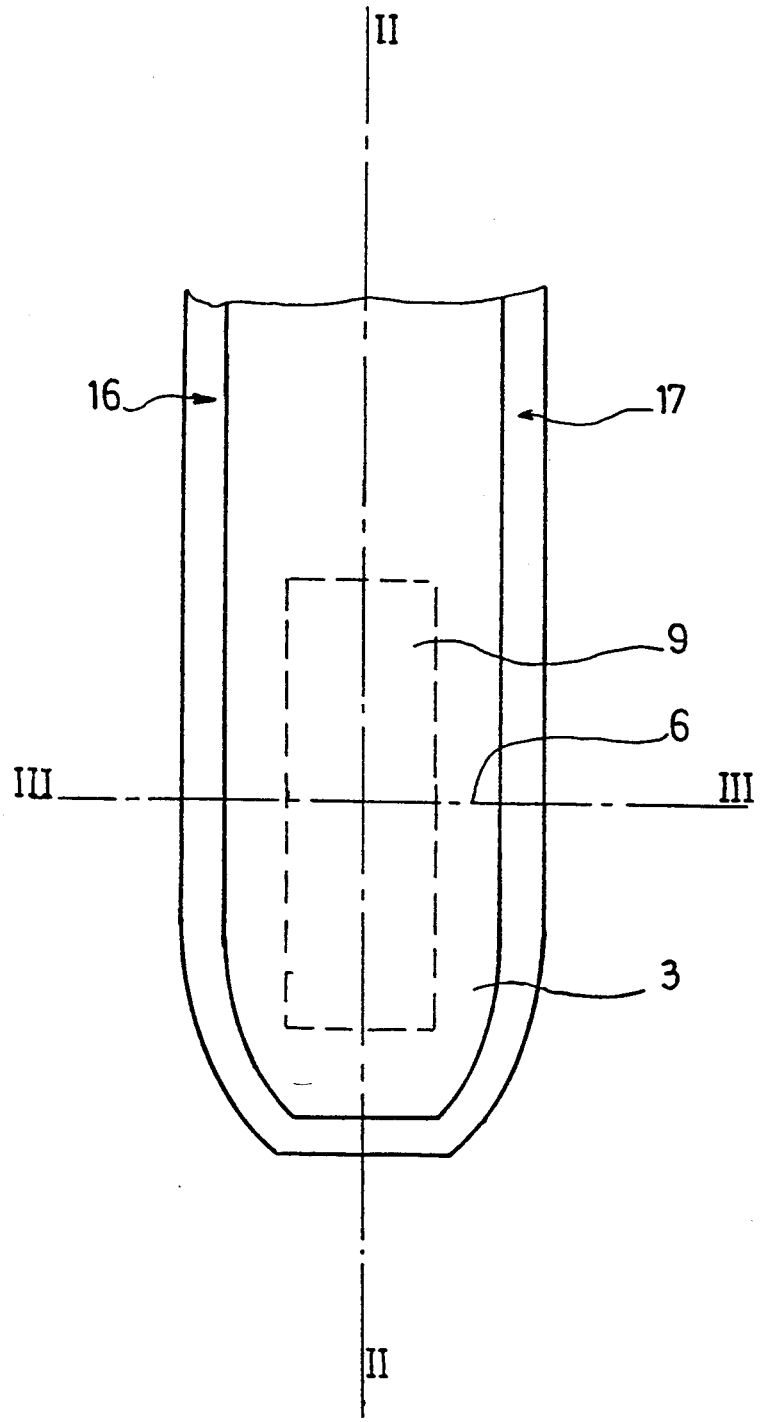
FIG. 5 is a top view illustrating the positioning of a rear additional mass of inertia according to the present invention.

FIG. 5 is a top view showing the rear portion of a ski which comprises a rear additional mass of inertia 9. In this embodiment, additional mass of inertia 9 is distributed over a predetermined length in the longitudinal direction of the ski and extends on both sides of vertical plane III—III which passes through rear line of contact 6, and is centered near the vertical longitudinal median plane II—II of the ski.

For different types of skis which have different characteristics, for example, a slalom ski, giant slalom ski, downhill ski, or multi-purpose ski, it is possible to substantially influence the behavior of the ski by adjusting the value of additional masses of inertia 8 and 9. Preferably a front additional mass of inertia 8 of a weight between 40 and 200 grams and a rear additional mass of inertia 9 of a weight between 0 and 100 grams are selected. Generally, front additional mass of inertia 8 has a weight greater than rear additional mass of inertia 9, the difference between the two masses being approximately 50 grams.

It is noted that when front additional mass of inertia 8 has a weight exceeding 75 grams, it is necessary to compensate for the oversteering effect thus obtained by positioning an additional mass of inertia 9 at the rear.

In certain situations, it is preferable to distribute the front and rear additional masses on both sides of the vertical longitudinal median plane II—II of the ski, with each mass being distributed in a non-uniform manner over the width of the ski. For example, they may be distributed as two half-masses being equal to half of the total additional mass of inertia on each of the ski edges. A ski is not only subject to flexion and pivoting forces, but also to torque forces and other stimuli. Therefore, the distribution of masses adjacent to the ski edges particularly modifies torque vibration and shock absorption of the ski.

Thus, in FIGS. 6–10, various embodiments of additional masses of inertia are shown, in which the masses are positioned more or less away from the center and on the edges of the ski.

Figure 6:
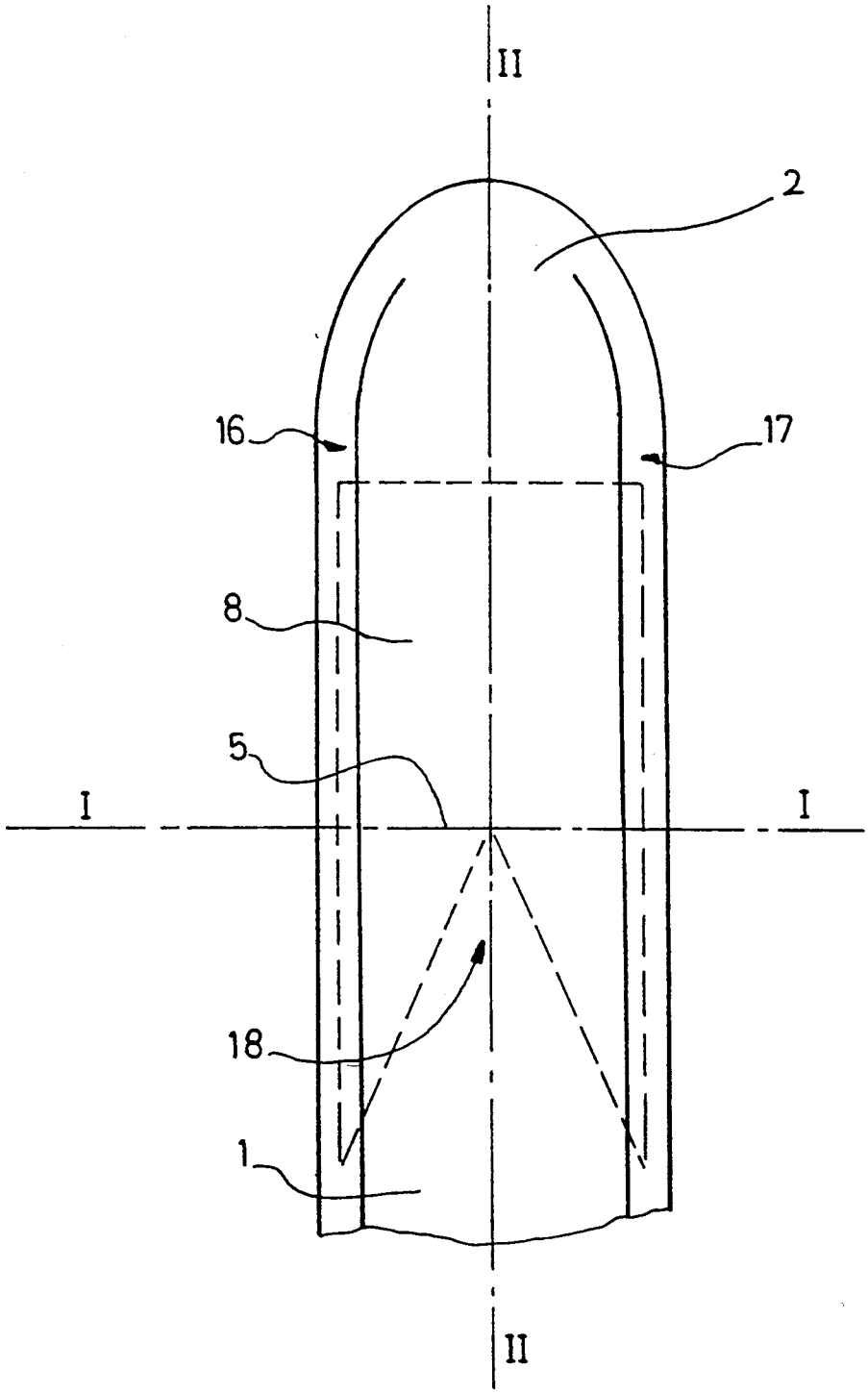
FIG. 6 shows, in top view, a second embodiment of the front additional mass of inertia.

In FIG. 6, front additional mass of inertia 8 is a plate comprising a central V-shaped cutout 18, so that mass 8 is distributed in a predetermined manner near ski edges 16 and 17. The distribution can be modified, and the effect thus obtained can be accentuated, by changing the thickness of the plate which forms mass of inertia 8. The thickness may be reduced near the longitudinal axis II—II of the ski since the thickness is more significant near the edges 16 and 17 of the ski.

Figure 7:
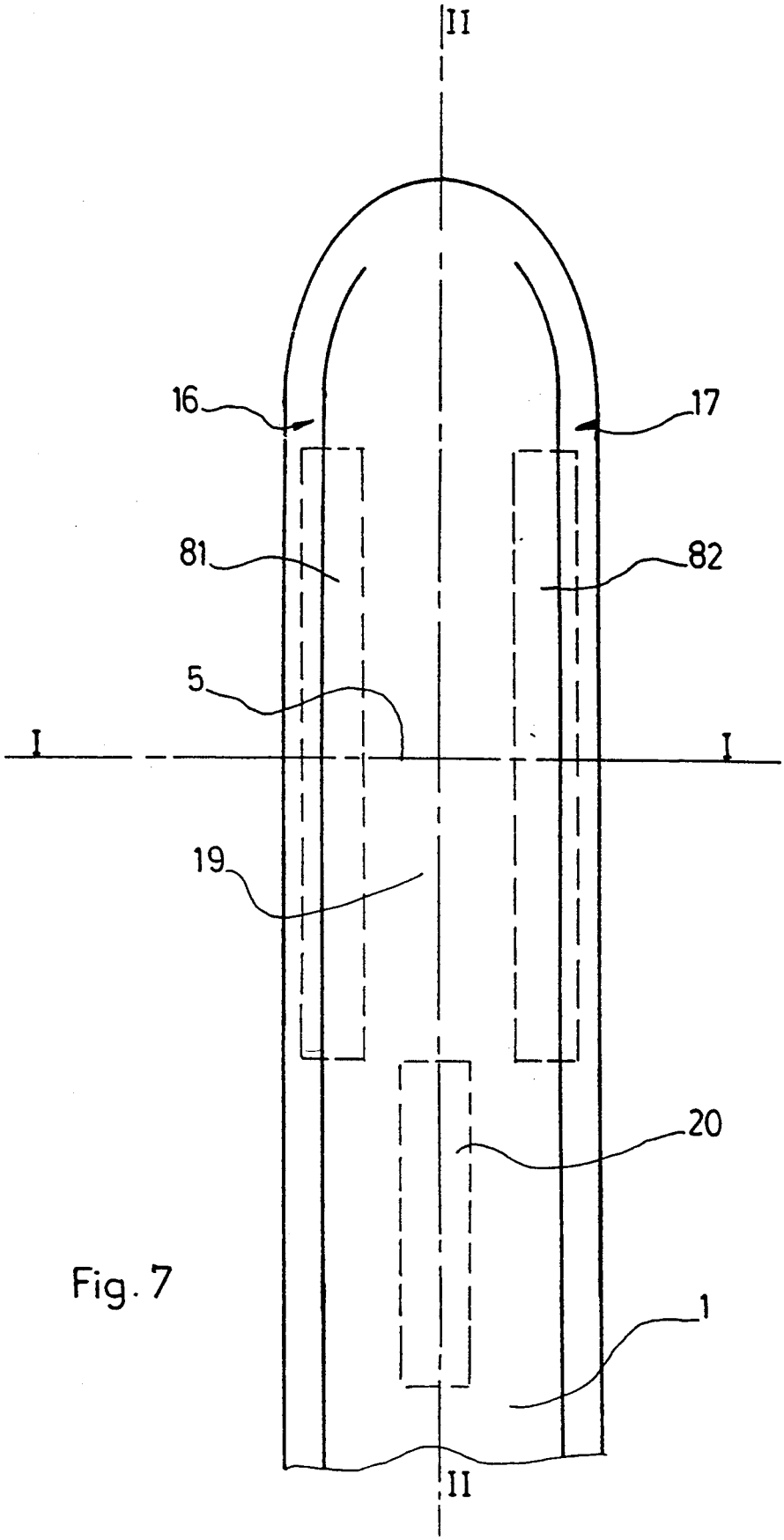
FIG. 7 shows, in top view, a third embodiment of the front additional mass of inertia, comprising two lateral half-masses.
Figure 9:
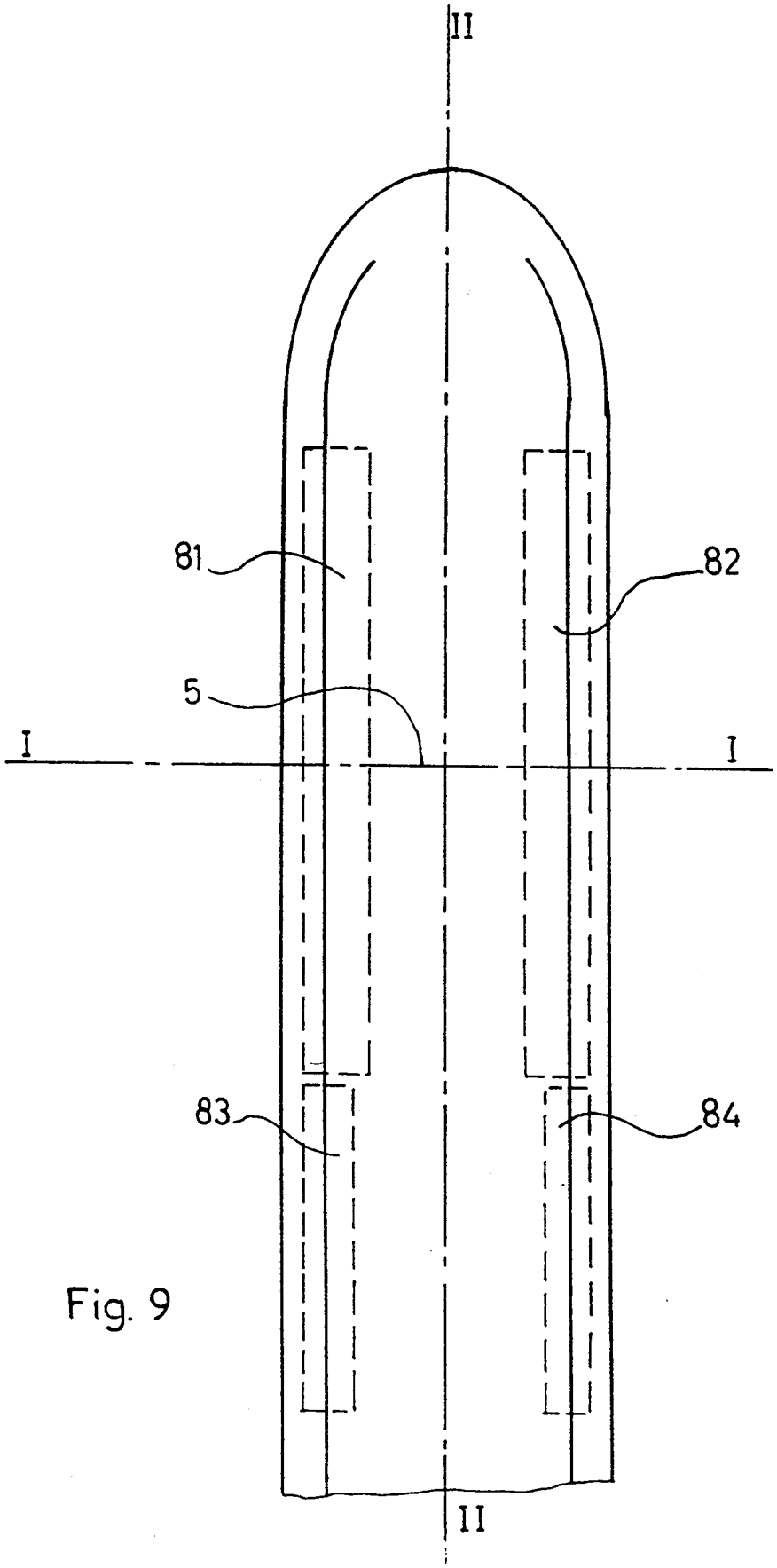
FIG. 9 illustrates another embodiment of the front additional mass of inertia according to the invention.
Figure 8:
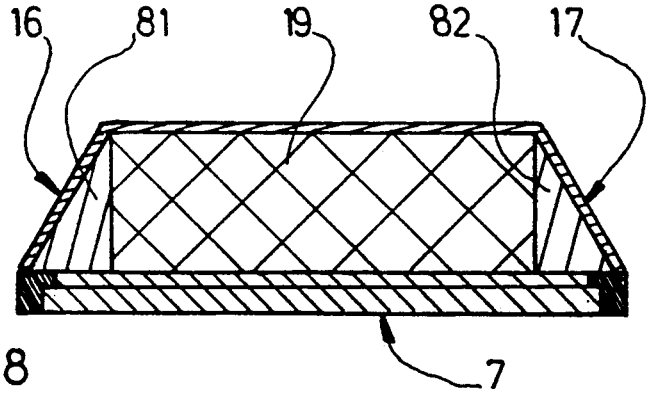
FIG. 8 is a transverse sectional view along plane I—I of FIG. 7.

FIGS. 7 and 8 show an embodiment in which front additional mass of inertia 8 of the ski is constituted by two half-masses 81 and 82, first half-mass 81 being positioned along edge 16 and second half-mass 82 being positioned along edge 17. The ski preferably has a cellular structure and a central core 19 of constant width. Core 19 is thus bordered on a portion of its length by half-masses 81 and 82, as shown in FIG. 8.

In skis having inclined edges 16 and 17, as shown in FIG. 8, half-masses 81 and 82 are preferably shaped to follow the inclined shape of the edges.

It is also possible to incorporate a third additional mass of inertia 20, which is centered on the longitudinal axis II—II of the ski, with two lateral half-masses 81 and 82, as shown in FIG. 7, to change the characteristics of the skis.

Alternatively, several lateral masses of inertia can be distributed near front line of contact 5. For example, in FIG. 9, two lateral half-masses 81 and 82 are shown which are similar to the half-masses of the preceding embodiments, but are associated with two additional lateral auxiliary masses 83 and 84 which are positioned behind additional masses 81 and 82.

Figure 10:
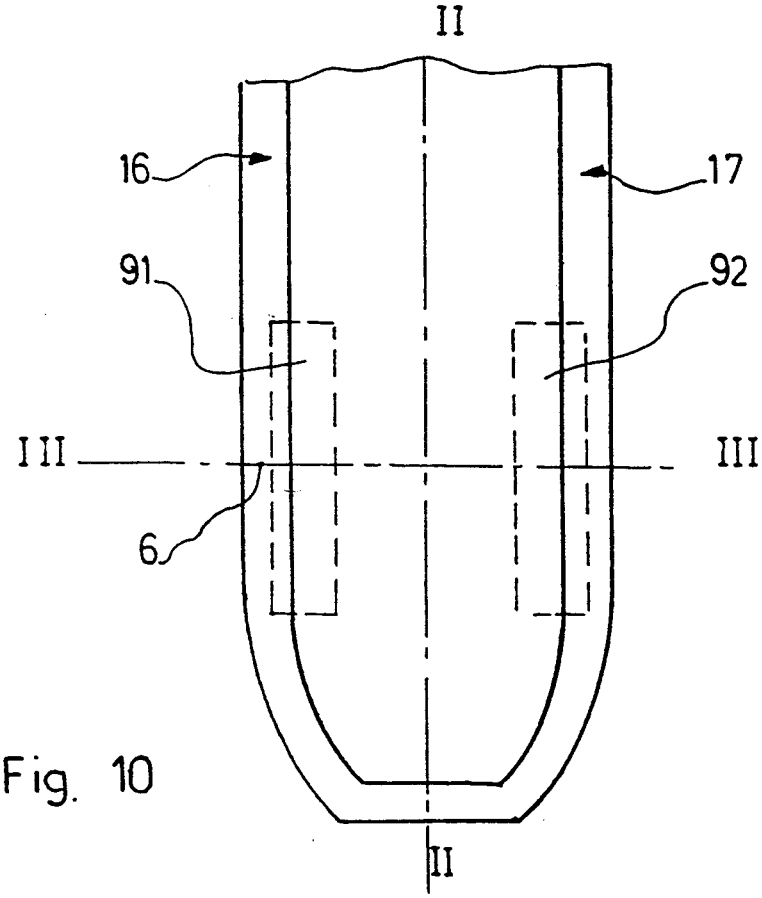
FIG. 10 illustrates a second embodiment of the rear additional mass of inertia according to the invention.

In FIG. 10, an embodiment is shown in which rear additional mass of inertia 9 is constituted by two lateral half-masses of inertia 91 and 92 which are positioned, respectively, near edges 16 and 17 of the ski.

In practice, the additional masses can be constituted by lead plates or other heavy materials. They can also be positioned in housings which are provided for that purpose. The housings for the additional masses can be formed by any conventional means of machining, such as milling, spindle molding, etc., either in central element 19' which forms the core, or in the lateral elements or edges. Moreover, the additional masses of inertia can be partially positioned in housings provided in core 19 and partially positioned in the lateral edges of the ski.

The additional masses of inertia can be made from a composite material, combining the forming and adhesive properties of a thermoplastic material and the density properties of a metal, such as lead, brass, and tungsten.

Although the invention has been described with reference to particular means, materials and embodiments, it is to be understood that the invention is not limited to the particulars disclosed and extends to all equivalents within the scope of the claims.

We claim:

1. A ski having a longitudinal axis, said ski comprising:

a) an upper and lower surface;

b) a front end which is turned upwardly;

c) said lower surface including a contact surface for contacting the ground which is connected to said front end at a front transverse line of contact, the front transverse line of contact being defined at the position at which the unloaded ski contacts a sliding surface, said front transverse line of contact being transverse to said longitudinal axis;

d) said ski having an average density, a discrete front additional mass of inertia being substantially centered about said front transverse line of contact, so that said front additional mass of inertia is distributed on both sides of a vertical plane including said front transverse line of contact, said front additional mass of inertia being non-viscous and having a greater density than said average density of said ski; and e) said front additional mass of inertia comprising two half-masses, said two half-masses being positioned, respectively, on both sides of a plane passing through said longitudinal axis;

whereby the moment of inertia of the ski is affected by said front additional mass of inertia, both about a vertical axis and a horizontal axis, which is perpendicular to said longitudinal axis.

2. The ski according to claim 1, wherein said front additional mass of inertia has a length substantially between 15 and 25 centimeters.

3. The ski according to claim 1, wherein said ski is curved and shaped such that the contact pressure between said contact surface and the ground is relatively high at the location of said front additional mass of inertia.

4. The ski according to claim 1, wherein said front additional mass of inertia weighs between 40 and 200 grams.

5. The ski according to claim 1, further comprising a rear transverse line of contact, and a rear additional mass of inertia being positioned substantially at said rear

6. The ski according to claim 1, wherein said ski includes an internal structure, said front additional mass of inertia being incorporated into said internal structure.

7. The ski according to claim 1, wherein said ski includes laterally spaced edges, said two half-masses of inertia being respectively positioned substantially at said edges.

8. The ski according to claim 7, further comprising an auxiliary mass of inertia positioned along said longitudinal axis.

9. The ski according to claim 5, wherein the difference between the weight of said front additional mass of inertia and the weight of said rear additional mass of inertia is approximately 50 grams.

10. The ski according to claim 7, wherein said ski includes a core, said at least two half-masses being respectively positioned on both sides of said core.

11. The ski according to claim 7, wherein said edges include inclined sides, said at least two half-masses being shaped to follow the inclination of said inclined sides.

12. In a ski having an upper and lower surface, side edges, an internal core, and average density, a longitudinal axis, and a front end which is turned upwardly, said lower surface including a contact surface for contacting the ground, said contact surface being connected to said front end at a front transverse line of contact, said front transverse line of contact being transverse to said longitudinal axis and being defined at the position at which the unloaded ski contacts a siding surface, the improvement comprising a discrete front additional mass of inertia being substantially centered about said front transverse line of contact, so that said front additional mass of inertia is distributed on both sides of a vertical plane including said front transverse line of contact, said front additional mass of inertia being non-viscous and having a greater density than said average density of said ski, and said front additional mass of inertia including two half-masses being positioned, respectively, on both sides of a plane passing through said longitudinal axis;

whereby the moment of inertia of the ski is affected by said front additional mass of inertia, both about a vertical axis and a horizontal axis, which is perpendicular to said longitudinal axis.

13. The improvement according to claim 12, said two half-masses of inertia being respectively positioned substantially at said side edges.

14. The improvement according to claim 13, wherein said at least two half-masses are respectively positioned on both sides of side core.

15. The improvement according to claim 13, wherein said side edges include inclined sides, said at least two half-masses being shaped to follow the inclination of said inclined sides.

16. The improvement according to claim 12, wherein the ski includes a rear transverse line of contact, and further including a rear additional mass of inertia located substantially at said rear transverse line of contact.

* * * * *